US005915395A

United States Patent [19]

Smith

[11] Patent Number: 5,915,395

[45] **Date of Patent: *Jun. 29, 1999**

[54] METHOD FOR THE CLEANING OF WATER MAINS

[75] Inventor: Ronald S. Smith, Kingwood, Tex.

[73] Assignee: ST Environmental Services, Houston, Tex.

[21] Appl. No.: 08/864,283

[22] Filed: May 28, 1997

Related U.S. Application Data

[60] Provisional application No. 60/018,572, May 29, 1996.

[51] Int. Cl.[6] ..... B08B 3/04; B08B 9/02

[52] U.S. Cl. ..... 134/22.12; 134/22.14

[58] Field of Search ..... 134/22.11, 22.12, 134/22.13, 22.14, 37

[56] References Cited

U.S. PATENT DOCUMENTS

| | | | |
|---|---|---|---|
| 4,818,298 | 4/1989 | Shishkin et al. | 134/22.14 |
| 5,007,461 | 4/1991 | Naf | 134/22.12 |
| 5,045,352 | 9/1991 | Mueller | 134/22.12 |
| 5,127,961 | 7/1992 | Aiton | 134/22.12 |

OTHER PUBLICATIONS

Elvidge, A. F., Air Scouring of Water Mains—A Method of Operation, Apr. 1982, pp. 1–46.

*Primary Examiner*—Lyle A. Alexander
*Assistant Examiner*—Saeed Chaudhry
*Attorney, Agent, or Firm*—Vinson & Elkins, L.L.P.

[57] ABSTRACT

A method of cleaning water mains includes isolating a section of water main. Compressed air is then used to blow out the water within the water main. The water main is actually cleaned by interspersing slugs of water between sections of compressed air. The compressed air includes atomized chlorine and a polyphosphate inhibitor. Once the water main has been cleaned, the flow of water is returned to the isolated section.

6 Claims, 2 Drawing Sheets

METHOD FOR THE CLEANING OF WATER MAINS

This application claims the benefit of U.S. Provisional Patent Application Ser. No. 60/018,572, filed May 29,1996.

FIELD

The present invention is related to systems which are used for the cleaning of water mains; more particularly, the present invention involves systems which use compressed air for the cleaning of water mains.

BACKGROUND

In this country there is a recurring need to clean the water mains or pipes which deliver potable water to residences or businesses. Consumers of potable water often notice the need to clean water mains by the observance of discolored water or reduced water pressure. When such discolored water or reduced pressure is noticed, the cleaning of water mains in the United States has been accomplished primarily by either flushing the water main with large quantities of clean water or physically passing a "pig" or a "swab" through the water main. In extreme cases, old water mains are dug up and replaced by new water mains.

Generally, the flushing of water mains has proven to be ineffective because undisturbed mineral scale or sediment in previously uncleaned water mains is loosened by the flushing water so that it may continue to enter the flow of water after the flushing has been completed. This entry of mineral scale or sediment into water mains oftentimes exacerbates the problems faced by water users. Comprehensive flushing programs also do little to resolve and prevent future water discoloration. In addition to wasting a tremendous amount of water, flushing only temporarily clears the center of the water main. This is due to the nature of water flow through a circular conductor such as a pipe. Because water flows most freely in the center of the pipe, very little flow occurs near the pipe walls. Therefore, flushing has little or no effect on mineral scale or sediment which builds up on the pipe walls. As mentioned earlier, flushing causes some mineral scale or sediment to actually re-enter the water stream and possibly produce additional discoloration or reduced pressure of the water provided to users.

The use of a mechanical "pig" or a "swab" has become the most commonly used method of cleaning water mains in the United States. Swabbing involves inserting a bullet-shaped "sponge" into the water main and then forcing the "sponge" one or more times through the water main using system water pressure. The insertion and extraction points for the sponge are typically fire hydrants. These fire hydrants must be disassembled to properly insert the sponge into the water main. The swabbing or pigging process is repeated on an isolated section of water main until all mineral scale and sediment is pushed out. The major benefit to swabbing or pigging is the high degree of cleaning achieved. There are, however, disadvantages to swabbing or pigging. Specifically, the swabbing or pigging process is costly and timely. This cost and time is related in part to the disassembly and reassembly of the fire hydrants to introduce the swab or the pig into the section of the water main to be cleared. Swabbing or pigging is also limited in its application as it cannot be performed on water mains which include "butterfly" or 90 degree pivot valves.

Professionals in the water distribution industry realize that periodic cleaning of water mains is a necessary part of the proper maintenance of a water distribution system.

Therefore, in addition to responding to the complaints of consumers it is also necessary to make the cleaning of water mains a regularly scheduled maintenance event.

In the U.K., the cleaning of water mains has been accomplished by a process termed "air scouring." The process of air scouring involves isolating a section of a water main, and then purging the standing water from the isolated section of the water main with high volume, high velocity, low pressure compressed air. Slugs of water are produced through the passage of controlled amounts of water into the isolated section of the water main. The compressed air causes these slugs of water to swirl through the water main removing mineral scale and sediment. The water main is restored to full service following the process of air scouring.

While the basic system of air scouring has shown great promise for utilization in the United States, there are certain modifications that must be made to assure that the system is acceptable for use in the water distribution systems found in most U.S. cities, towns, municipalities, and rural areas.

SUMMARY

The method of cleaning water mains of the present invention involves isolating a section of the water main between an entry point and an exit point. A flow of pressurized air is passed into the water main to blow out all the water which is resident in the isolated section of the water main. Once all the water has been removed, a flow of air including atomized chlorine is inserted into the water main in-between slugs of water. The swirling action of the pressurized air and the slugs of water cleans out the isolated section of the water main. During the process of cleaning the water main, a polyphosphate inhibitor is injected into the flow of compressed air to soften the mineral scale buildup on the inside wall of the pipes. After the water main has been cleaned, the flow of water is restored to the isolated section of the water main.

BRIEF DESCRIPTION OF THE FIGURES

A better understanding of the method and apparatus for the cleaning water mains of the present invention may be had by reference to the figures wherein.

DESCRIPTION OF THE EMBODIMENTS

The process of air scouring water mains to clean out debris and other unwanted matter has been in use in the United Kingdom for several years. This system was described in a Water Research Center paper entitled "Air Scouring of Water Mains—A Method of Operation" by A. F. Elvidge, dated April 1982. That paper is incorporated herein by reference.

The process of air scouring involves using compressed air to blow slugs of water through a water main. The swirling action of the compressed-air-propelled-slugs-of-water through the water main removes loose matter and debris, to include mineral scale and sediment, from the inside of the water main and restores the water main to full flow capacity. Users of water connected to the water main will notice that the flow of water through a cleaned water main is much clearer and stronger than the water passing through an uncleaned water main.

Figure 1:
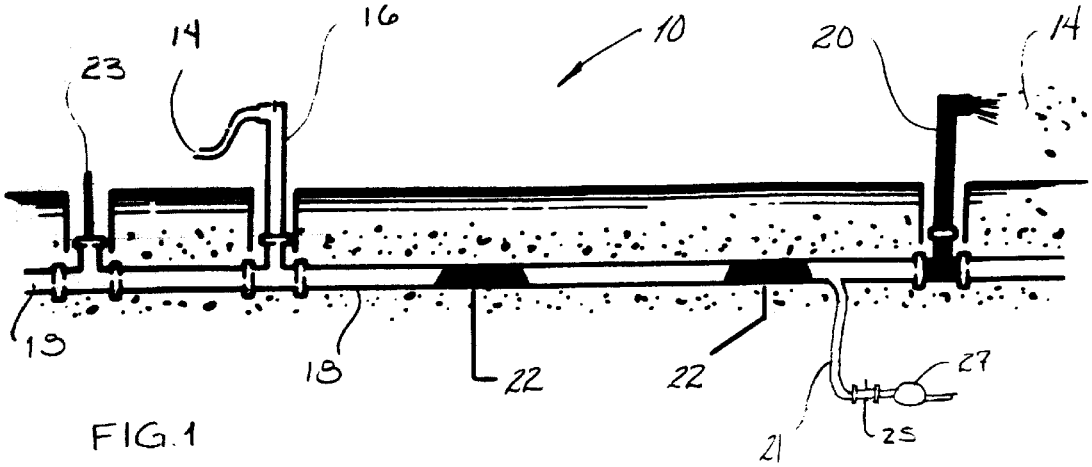
FIG. 1 is a schematic diagram of a water main showing the flow of slugs of water between the entry point and the exit point.
Figure 2:
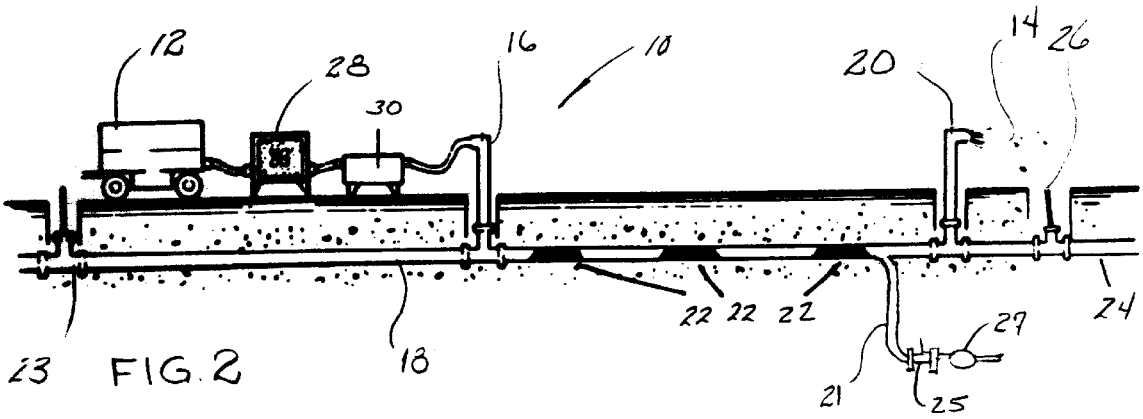
FIG. 2 is a schematic diagram similar to FIG. 1 showing one arrangement of the equipment used for cleaning water mains.

The air scouring system 10 of the present invention is illustrated in its most basic form by reference to FIGS. 1 and 2. Therein it may be seen that a source 12 of compressed air 14 is connected to an entry point 16 in the water main 18. Typically, such an entry point 16 will be a fire hydrant. Downstream along the water main 18 a second fire hydrant is designated as the exit point 20. The downstream section 24 of the water main is closed at its shut off valve 26. Upstream from the entry point 16 the section water main 18 to be cleaned is isolated by closing valve 23. The compressed air 14 entering the water main 18 at the entry point 16 is used to blow any water within the water main 18 out through the exit point 20. The completion of this process will be readily evident when no more water passes through the exit point 20. When the water main 18 is deemed to be free of water, compressed-air-propelled-slugs-of-water 22 are introduced into the water main at the entry point 16. This is accomplished by intermittently opening and closing the valve 23 located upstream of entry point 16 to the water main 18. This intermittent opening and closing of the valve 23 causes the compressed-air-propelled-slugs-of-water 22 to pass into the water main 18. The compressed-air-propelled-slugs-of-water 22 are driven through the water main 18 by the compressed air 14 and exit the water main 18 downstream through the exit point 20. The water main 18 is also disinfected by the injection of an atomized spray of 10% chlorine solution into the flow of pressurized air 14. The level of chlorine used is approximately 0.3 to 0.5 mg per liter more than what is shown in a pre-cleaning sample of the water. To soften encrusted minerals located on the inside of the water main a polyphosphate inhibitor is injected into the water passing into the water main 18 one or two weeks before the actual air scouring takes place. Then during the actual air scouring of the water mains 18 the polyphosphate inhibitor is also injected at a rate of about 20 to 40 ppm into the flow of compressed air 14. Polyphosphate inhibitors sold under the trademarks "Aqua Mag" by Yaeger Chemical and "QW4095" by Seatex have provided satisfactory results.

The arrangement of equipment used to accomplish the air scouring of water mains 18 is illustrated in FIG. 2. Therein it may be seen that a compressor 12, typically a screw compressor, serves as the source 12 of compressed air. The compressed air 14 is cooled 28 and filtered 30 before being injected into the water main 18.

Figure 4:
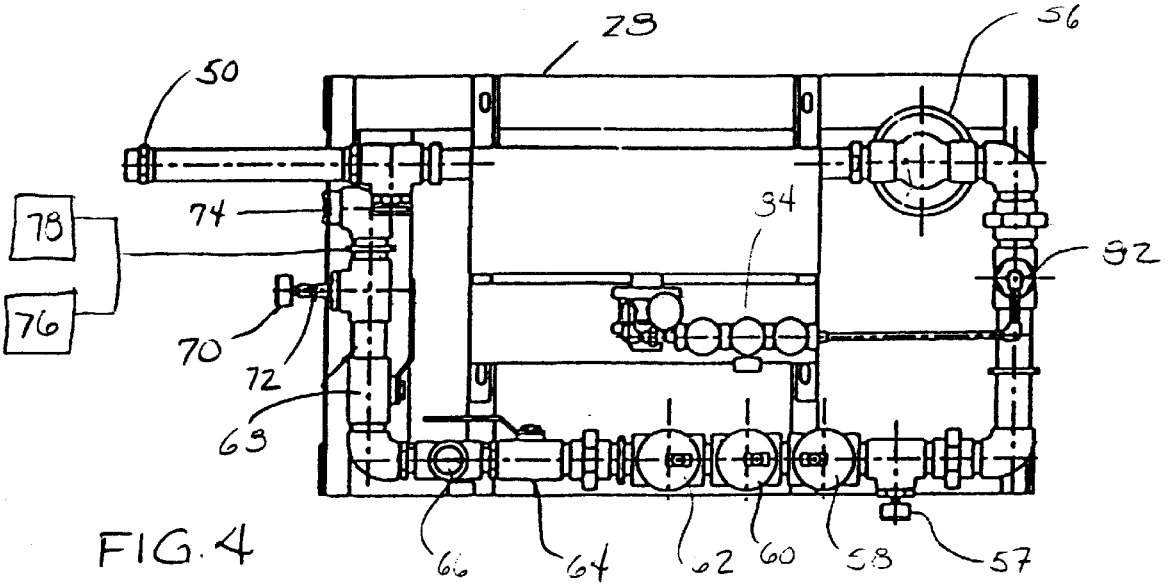
FIG. 4 is a top plan view of the apparatus shown in FIG. 3.
Figure 3:
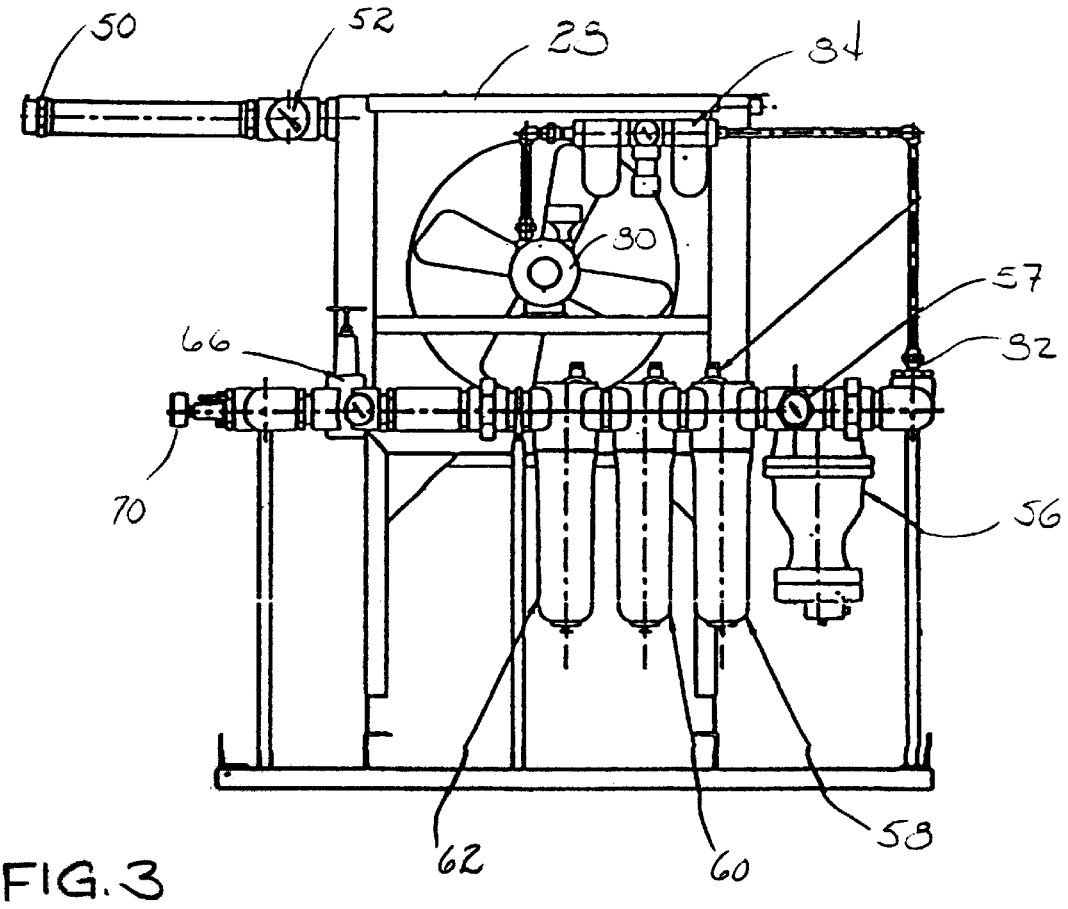
FIG. 3 is a side elevational view of the apparatus used for processing the air to be inserted into the water main.

The apparatus for cooling 28 and filtering 30 the air to be injected into the water main 18 is illustrated in FIGS. 3 and 4. Therein it may be seen that the compressed air enters an inlet connection 50 before flowing past a temperature gauge 52. Downstream from the temperature gauge 52 is an after cooler 28. The after cooler 28 cools the compressed air 14 before it enters the water main 18. Downstream from the after cooler 28 is an oil separator 56. This oil separator 56 is placed in the air flow line to remove any oil which may be in the compressed air 14. While an "oil free" air compressor is preferably used, it has been found that some "oil free" compressors still leave a trace of oil in the compressed air 14. To assure that the water main being cleaned is not contaminated by any residual oil from the air compressor, the air compressor 12 is lubricated with an FDA approved food grade oil. Any small portions of food grade oil that may remain in the compressed air 14 are removed as the compressed air 14 passes through the oil separator 56. To further cleanse the compressed air 14, it passes through a filter section 30. Air pressure is monitored by a pressure gauge 57. In the preferred embodiment, the filter section 30 includes a prefilter 58 and two after filters 60 and 62. Downstream from the filter section 30 is a ball valve 64 for controlling the flow of compressed air 14. Downstream from the ball valve 64 is a pressure regulator 66. Downstream from the pressure regulator 66 is a check valve 68 which allows the compressed air 14 to flow only one way through the air processing apparatus. Downstream from the check valve 68 is a pressure gauge 70 with an associated bleed valve 72. Downstream from the pressure gauge 70 is the outlet connection 74 through which the compressed air 14 passes into entry point 16 into the water main 18.

The after cooler 28 is driven by an air motor 80 which receives compressed air 14 from a tap 82 located downstream from the oil separator 56. A lubricator/regulator/filter assembly 84 is placed between the tap 82 and the air motor 80.

As shown in FIG. 4 an atomized chlorine injector 76 and a polyphosphate inhibitor injector 78 are located in the system just before the outlet 74.

In the preferred embodiment of employing the water main cleaning system of the present invention in a populated neighborhood, the process begins by notifying all the users of water of the upcoming cleaning of the water mains. Those users with special needs may be supplied with bottled water and those who do not have special needs are urged to make arrangements for a period of time during which no water will be available through the water fixtures in their residences. The next step involves closing off all branches 21 to the section of water main 18 to be cleaned. This is accomplished by closing the branch valves 25 placed at various branches 21 of the water main to residences or businesses. Typically, these branch valves are located upstream of the various water flow measuring meters 27 used to monitor the amount of water flowing into individual residences and businesses along the water main 18. If any branch valves 21 are inoperative they must be repaired or replaced before the water mains can be deemed. In addition, if upstream valve 23 or downstream valve 26 is inoperative, these valves must be repaired or replaced before the air scouring operation can be undertaken.

The next step involves passing the pressurized air 14 into the isolated section of the water main 18. This is conveniently accomplished by the use of the fire hydrants located along a water main 18 for access into the water main 18. The compressed air 14 is passed into the entry fire hydrant 16 after the fire hydrants and connecting air hoses have been sprayed with some type of commonly available disinfectant solution. The compressed air 14 includes atomized chlorine 76 to kill any germs which may exist in the hoses or the fire hydrant. Once the pressurized air 14 has been connected to the water main 18, the downstream exit point 20 on the water main 18 is opened and the water, once filling the water main 18, is allowed to be flushed out by the force of the compressed air 14. It has been found that the volume of air used is more important than the pressure of air used. Typically, the pressure of the compressed air is at least 15 psi below the normal pressure of the water in the water main 18. Once all the water in the water main 18 has been blown out, the valve 23 at the entry point 16 is intermittently opened and closed. This intermittent opening and closing allows compressed-air-propelled-slugs-of-water 22 to pass into the water main 18. These slugs of water 22 are pushed through the water main 18 by the continuous flow of compressed air 14. The swirling action of loosened scale, debris, or sediment actually enhances the cleaning process. After the water main 18 has been cleaned, the air compressor 12 is detached from the water main 18, the branches 21 of the water main are opened up, and the flow of water is restored to the water main 18.

Those of ordinary skill will understand that while the present invention has been described by reference to its preferred embodiment, other embodiments of the present invention will become apparent to those of ordinary skill in the art once having read the foregoing description. For example, the present invention may not be limited to water mains as the same principle of operation may be used to clean any types of pipe plagued by the build-up of scale along interior walls. Such other embodiments shall be included within the scope and meaning of the appended claims.

I claim:

1. A method of cleaning water mains for distributing water to users through water flow measuring meters, said method comprising the steps of:

a) notifying all water users of the upcoming cleaning of the water mains;

b) isolating a section of the water main to be cleaned from water input and water output between an entry point and an exit point;

c) closing off all branches of said isolated section of the water mains to be cleaned upstream from the water flow measuring meters;

d) connecting a flow of pressurized air to the entry point of said isolated section of water mains to be cleaned;

e) injecting atomized chlorine into said flow of pressurized air to disinfect said mains;

f) injecting a polyphosphate inhibitor into said flow of pressurized air to soften the deposits in said main, said atomized chlorine and polyphosphate inhibitor being present simultaneously in said flow of pressurized air;

g) utilizing said pressurized air to blow out all water in said isolated section of water main through said exit point;

h) inserting slugs of water into said isolated section of water main at said entry point;

i) allowing said pressurized air and said slug of water to exist said isolated section of said water main at said exit point;

j) removing said flow of pressurized air from said isolated section of water main;

k) opening up all branches of said isolated section of water main;

l) restoring the flow of water to said isolated section of water main.

2. The method as defined in claim 1 wherein any broken or defective valves are repaired or replaced after step c.

3. The method as defined in claim 1 wherein the pressure of said pressurized air is at least 15 psi below the pressure of the water normally flowing through the water main.

4. The method as defined in claim 1 wherein the amount of atomized chlorine is approximately 0.3 to 0.5 mg per liter more than shown in a pre-cleaning sample of the water.

5. The method as defined in claim 1 wherein the amount of polyphosphate inhibitor is about 20 ppm to about 40 ppm.

6. The method of cleaning water mains as defined in claim 1 wherein additional polyphosphate inhibitor is injected into the water mains approximately one to two weeks prior to step b) while said water mains are still filled with water and are in service.

* * * * *